US010975573B1

(12) United States Patent
Strabala

(10) Patent No.: US 10,975,573 B1
(45) Date of Patent: Apr. 13, 2021

(54) SPACER FOR MULTIPLE CAGE REINFORCEMENT WIRE MESH FOR CONCRETE PRODUCTS

(71) Applicant: HawkeyePedershaab Concrete Technologies, Inc., Clayton, MO (US)

(72) Inventor: Dave Strabala, Mediapolis, IA (US)

(73) Assignee: HAWKEYEPEDERSHAAB CONCRETE TECHNOLOGIES, INC., Clayton, MO (US)

( * ) Notice: Subject to any disclaimer, the term of this patent is extended or adjusted under 35 U.S.C. 154(b) by 0 days.

(21) Appl. No.: 16/884,572

(22) Filed: May 27, 2020

Related U.S. Application Data

(60) Provisional application No. 62/977,962, filed on Feb. 18, 2020.

(51) Int. Cl.
*E04C 5/16* (2006.01)

(52) U.S. Cl.
CPC ..... *E04C 5/168* (2013.01); *E04C 5/167* (2013.01)

(58) Field of Classification Search
CPC ..... E04C 5/168; E04C 5/167
See application file for complete search history.

(56) References Cited

U.S. PATENT DOCUMENTS 1,750,106 A * 3/1930 Heltzel ..... E04C 5/168 404/135
4,999,965 A 3/1991 Schmidgall et al.
D330,846 S * 11/1992 Woolledge ..... D8/354
5,832,690 A * 11/1998 Kaines ..... E04C 5/163 52/677
5,896,722 A * 4/1999 Swenson ..... E04C 5/163 403/391
6,655,105 B2 * 12/2003 Swenson ..... E04C 5/163 403/391

* cited by examiner

*Primary Examiner* — Adriana Figueroa
(74) *Attorney, Agent, or Firm* — Shuttleworth & Ingersoll, PLC; Jason R. Sytsma

(57) ABSTRACT

A continuous length of material comprising a central straight portion. An arcuate bend is formed at the first end by a downward bend relative to the central straight portion. An eye extends from the arcuate bend with a first end extending from the arcuate bend and a second end formed from an upward bend in the continuous length of material to elevate the second end of the eye above the central straight portion. A locking leg extends from the second end of the eye downward forming a locking hook.

18 Claims, 2 Drawing Sheets

SPACER FOR MULTIPLE CAGE REINFORCEMENT WIRE MESH FOR CONCRETE PRODUCTS

This application claims priority to U.S. Provisional Patent Application No. 62/977,962 filed on Feb. 18, 2020, the content of which are hereby incorporated by reference herein.

TECHNICAL FIELD

This disclosure relates to the production of concrete products, and more specifically, this disclosure relates to a spacer for multiple cage reinforcement wire mesh for concrete products.

BACKGROUND INFORMATION

In producing large concrete products such as box sections, round pipes, culverts or manholes, two reinforcement wire mesh cages are required to provide the necessary strength. The cages must be spaced from each other and also spaced from the surfaces of the form used to produce the particular concrete product.

For concrete products of sufficient size, standards require a minimum amount of steel reinforcement which can exceed two reinforcement wire mesh cages. For such products, one cage with large diameter wires or two on each side or more wire mesh cages may be placed together on each side of the form to provide the necessary reinforcement strength. In other words, rather than one reinforcement wire mesh cage on each side of the form, as shown in U.S. Pat. No. 4,999,965, two or more cages on each side of the form may be provided.

Accordingly, there is a need for an improved spacer that can be used with multiple cage reinforcements.

SUMMARY

In accordance with one aspect of the present invention, a spacer for positioning apart a first plurality of cages from a second plurality of cages used in forms for producing concrete structures is disclosed. The spacer can be constructed of a continuous length of material comprising a central straight portion with a first end and a second end. An arcuate bend is formed at the first end of the central straight portion by a downward bend relative to the central straight portion. An eye extends from the arcuate bend with a first end extending from the arcuate bend and a second end formed from an upward bend in the continuous length of material to elevate the second end of the eye above the central straight portion. A locking leg extends from the second end of the eye downward and upward forming a locking hook being engageable with either a vertical or horizontal wire of the cage.

The arcuate bend can have a radius and wherein the locking hook has a bend with a radius and wherein a plane perpendicular to the radius of the arcuate bend is parallel to a plane perpendicular to the radius of the bend of the locking hook. The radius of the arcuate bend and the radius of the bend of the locking hook can lie on the same vertical plane. The locking hook can extend, inwardly and then upwardly around the same wire as engaged by the arcuate bend.

In an embodiment, the eye further comprises of a rounded nose that is engageable with the inner surface of the concrete form to position the outer cage a predetermined distance away from the inner surface of the concrete form.

BRIEF DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENTS

Figure 1:
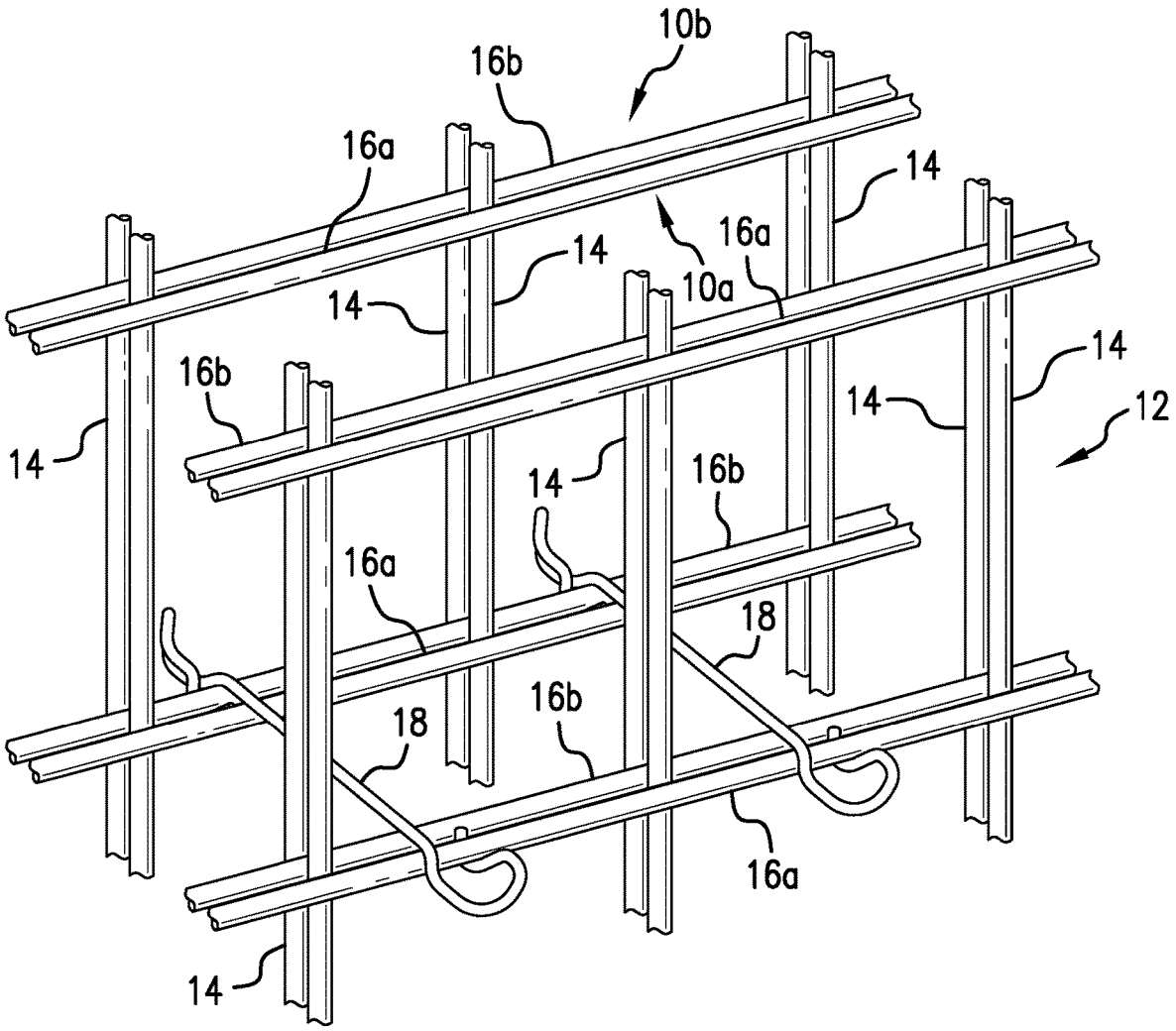
FIG. 1 is a perspective view showing a portion of two wire mesh cages with the spacers according to this disclosure locked in place.

Referring to FIG. 1, there is illustrated a reinforcement wire mesh cage that is required for the larger round and rectangular pipes, culverts and manhole concrete products. An inner cage 10 and an outer cage 12 each have a plurality of parallel spaced apart vertical wires 14 joined to a plurality of horizontally spaced apart parallel circumferential wires 16. As is well known to those skilled in the art, these cages 10 and 12 are positioned inside of the annular space defined by the forms used in producing a particular rectangular or cylindrical concrete product that will ultimately used as a box section, a pipe, culvert, or manhole. The cages 10 and 12 therefore must be properly positioned inside of the annular space between the forms, which space will be filled with concrete surrounding the reinforcement cages and it is important that the cages 10 and 12 be properly spaced from each other and also properly spaced from the surfaces of the form. It is also important that the cages maintain the proper position throughout the process of producing the concrete product. Since these processes employ vibration and other forces to assure that all of the voids in the form are filled with concrete, twisting and other forces are exerted upon the cages 10 and 12 during the process of manufacture. The spacers constructed according to the principles of the invention are capable of resisting all of the forces, twisting and otherwise, and once in place, the spacers of the invention will not fall off even though not welded or otherwise tied to the cages.

Figure 2:
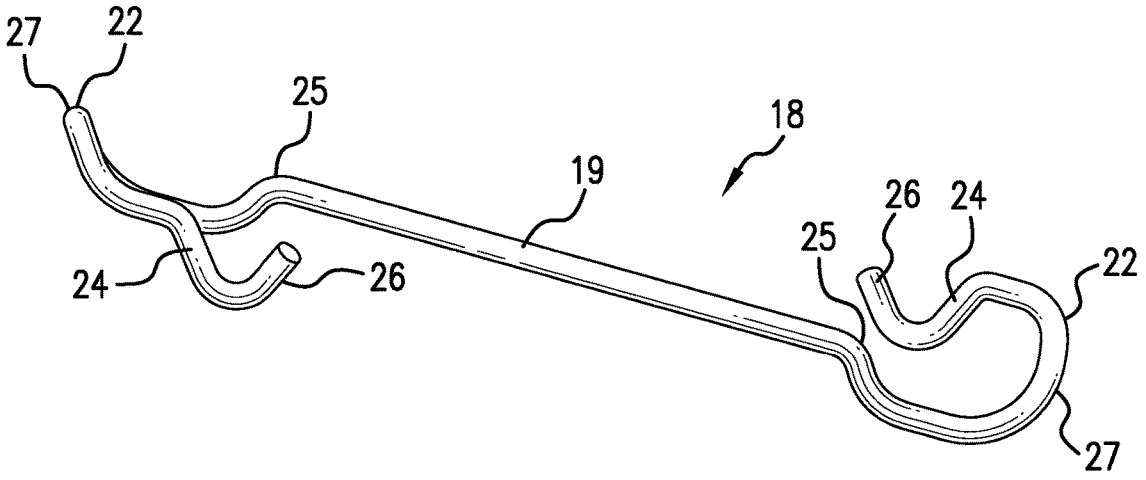
FIG. 2 is a perspective view of the spacer of FIG. 1.
Figure 3:
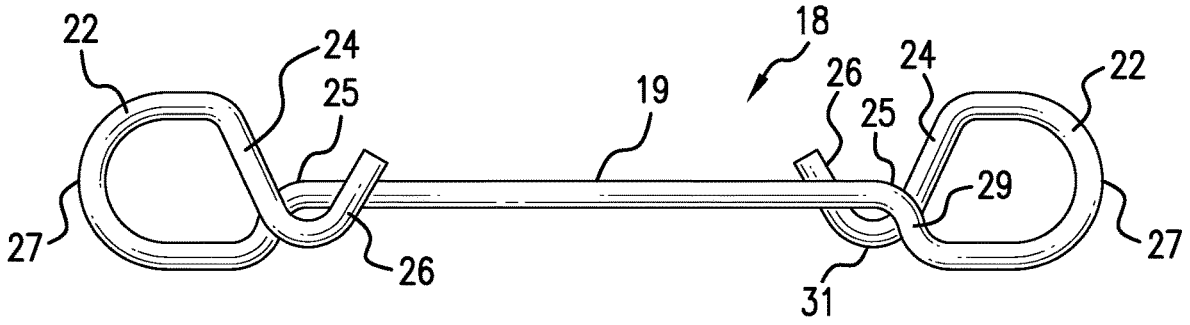
FIG. 3 is a side elevational view of the spacer of FIG. 1.

In FIGS. 2-3, there are illustrated a spacer 18 designed primarily for use in connection with the rectangular cages used for box sections. These rectangular cages must be spaced from the surfaces of both the inner and outer concrete forms because the cages have no inherent resistance to forces tending to move them either inwardly or outwardly. To accomplish all of the necessary functions of spacing and positively locking the two cages 10 and 12, spacer 18 has a central straight portion 19 with an arcuate bend 25 at each end of central straight portion 19 by a downward bend 29 relative to central straight portion 19. These arcuate bend 25 at each end of straight portion 19 position both of the cages 10, 12 at the predetermined distance between each arcuate bend 25.

The benefit of each arcuate bend 25 is found when each of cages 10, 12 actually have two or more cages placed adjacent to each other, as shown in FIG. 1. For increased strength, according to code, instead of a single cage with thick diameter wire, multiple cages can be used instead of making a single cage with thicker horizontal wires 16 and vertical wires 14. As shown in FIG. 1, when cage 10 is actually two cages 10*a*, 10*b* tied together, the corresponding horizontal wires 16*a*, 16*b*, are also adjacent. To lock multiple cages, spacer 18 is provided with arcuate bend 25 formed at opposite ends of the straight portion 19, so straight portion 19 extends up and over horizontal wires 16*a*, 16*b*. This design can also be used with a single cage with thick diameter wire.

Referring back to FIGS. 2-3, in order to space the cages 10 and 12 from both the inner and outer surfaces of the concrete forms, an eye 22 is formed at the outer ends of the spacer, each eye 22 being in the form of an open loop with a rounded nose 27 that is engageable with the outer surface of the concrete form, the outer leg 24 of which is directed away from the plane of the central straight portion 19. The outer leg 24 at each end of the spacer terminates in a hook 26. In one implementation, arcuate bend 25 has a radius and locking hook has a bend 31 with a radius such that a plane perpendicular to the radius of arcuate bend 25 is parallel to a plane perpendicular to the radius of bend 31 of locking hook 26. This also means that the radius of arcuate bend 25 and the radius of bend 31 of locking hook 26 can lie on the same vertical plane. In functionality, this means that locking hook 26 can extend, inwardly and then upwardly around the same wire as engaged by arcuate bend 25 (i.e. the same wire that is closest to downward bend 29 of arcuate bend 25). The functions of the various configurations of the spacer are best understood by an explanation of how the spacer is installed on the cages 10 and 12.

The installer is normally outside of the outer cage 12, and to install spacer 18 on the cages 10 and 12, the installer grasps one end of spacer 18 and inserts it inwardly between two of the circumferential wires 16 on each of the cages 10 and 12. It makes no difference which end of spacer 18 is grasped, since spacer 18 is symmetrical and each end is identical. Once spacer 18 is inserted between two of the circumferential wires 16, it is rotated about ninety degrees until the hook 26 is beneath a circumferential wire 16 of the inner cage 10. Spacer 18 is then pulled outwardly until arcuate bend 25 at the inner end is just above the wire 16. Spacer 18 is then rotated clockwise approximately ninety degrees until the hook 26 at the inner end of the spacer is engaged beneath the wire 16 and arcuate bend 25 rests on top of that same wire 16. At this time, arcuate bend 25 at the outer end will also be resting on top of the corresponding circumferential wire 16 of the outer cage 12. Because the spacer 18 is made of spring steel, spacer 18 is then rotated further in a clockwise direction until the hook 26 at the outer end of the spacer 18 snaps beneath the circumferential wire 16 on the outer cage 12. This can require a simple tool in order to obtain the proper leverage and force to flex spacer 18 sufficiently so that the hook 26 at the outer end of the spacer can snap beneath the circumferential wire 16 on the outer cage 12. Once this is done, the spacer 18 is locked in place, and because the spring steel will return to its original shape, each end of the spacer 18 will be firmly locked onto a circumferential wire 16 of the inner cage 10 and the outer cage 12. The positive torsional locking and grasping of a wire 16 between arcuate bend 25 and the hook 26 at each end of the spacer is illustrated in FIG. 1. The installation therefore is quickly and easily done.

When properly installed as described above, the configuration of the spacer 18 tightly locks the inner cage 10 and outer cage 12 into an integral unit of reinforcement. The eyes 22 space both cages, and with the spacers 18 of the invention properly in place, the multiple cage rectangular reinforcement cannot move in either direction toward either surface of the form, and the multiple cage reinforcement will therefore stay properly positioned throughout the manufacturing process. Because of the positive torsional locking feature provided by the unique configuration at each end of the spacer 18 of the invention, the spacers 18 will not fall off during the manufacturing process, and the spacers 18 will resist forces in any direction without becoming loose. Also, there is no concern as to which way the spacer 18 is to be installed, since it is symmetrical and identical at each end, and provides spacing from both surfaces of the form.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

I claim:

1. A spacer for positioning a first plurality of cages and a second plurality of cages used in forms for producing concrete structures, each cage of the first plurality of cages and the second plurality of cages has a plurality of parallel spaced-apart horizontal wires joined to a plurality of parallel spaced-apart vertical wires and the first plurality of cages and the second plurality of cages are positioned in a form that has spaced-apart inner surfaces, said spacer also serving to maintain the cages a predetermined distance away from the inner surfaces of the form, said spacer comprising:

a continuous length of spring-steel material of a substantially round cross-section comprising a circumference, a central substantially straight portion comprising an arcuate bend formed in the material near a first end of the spacer, the arcuate bend is between the straight portion and a downward bend that is at an angle greater than ninety degrees with respect to the straight portion and with the arcuate bend being formed to extend over the wires of the outer cage of one of the first plurality of cages and the second plurality of cages to position the outer cage, an eye extending outwardly from the arcuate bend to form a rounded nose that is engageable with the inner surface of the concrete form to position the outer cage a predetermined distance away from the inner surface of the concrete form, wherein the eye comprises of a radius, and a locking leg of the spacer extending downwardly and inwardly from the nose to form a locking hook at the first end of the spacer in a plane spaced from the plane of the eye wherein the locking hook comprises of a radius and said locking hook extending under, inwardly and then upwardly around the same one of the wires of the outer cage engageable by the arcuate bend; and wherein the continuous length of spring-steel material is positioned above the radius of the locking hook.

2. The spacer of claim 1, and further comprising another arcuate bend formed in the spring-steel material near a second end of the spacer, another eye extending outwardly from the other arcuate bend, and another locking leg which includes a downwardly and inwardly extending locking hook that also extends away from the plane of the eye and in a direction away from the plane of the locking hook at the first end of the spacer, the locking hook of the locking leg being engageable with either a vertical or horizontal wire of the outer cage.

3. The spacer of claim 2, wherein the other eye at the second end of the spacer extends outwardly from the other arcuate bend to form a rounded nose that is engageable with the other inner surface of the concrete form to position the outer cage a predetermined distance away from the other outer surface.

4. A spacer for positioning apart a first plurality of cages from a second plurality of cages used in forms for producing concrete structures, the spacer comprising:

a continuous length of material comprising a central straight portion with a first end and a second end;

an arcuate bend formed at the first end of the central straight portion, which is between the straight portion and a downward bend at an angle greater than ninety degrees relative to the central straight portion;

an eye extending from the arcuate bend with a first end extending from the arcuate bend and a second end formed from an upward bend in the continuous length of material to elevate the second end of the eye above the central straight portion; and a locking leg extending from the second end of the eye downward forming a locking hook comprising a radius and being engageable with either a vertical or horizontal wire of a cage of the first plurality of cages and the second plurality of cages, and wherein the continuous length of spring-steel material is positioned above the radius of the locking hook.

5. The spacer of claim 4, wherein the eye further comprises of a rounded nose that is engageable with an inner surface of the concrete form to position an outer cage of the first plurality of cages and the second plurality of cages a predetermined distance away from the inner surface of the concrete form.

6. The spacer of claim 5, wherein the arcuate bend has a radius and wherein the locking hook has a bend with a radius and wherein a plane perpendicular to the radius of the arcuate bend is parallel to a plane perpendicular to the radius of the bend of the locking hook.

7. The spacer of claim 6, wherein the radius of the arcuate bend and the radius of the bend of the locking hook lie on the same vertical plane.

8. The spacer of claim 7, wherein each cage in the first plurality of cages comprises of a plurality of parallel spaced-apart horizontal wires joined to a plurality of parallel spaced-apart vertical wires and which cages are positioned in a form that has spaced-apart inner surfaces, and wherein the locking hook extends, inwardly and then upwardly around the same wire as engaged by the arcuate bend.

9. The spacer of claim 4, wherein the arcuate bend has a radius and wherein the locking hook has a bend with a radius and wherein a plane perpendicular to the radius of the arcuate bend is parallel to a plane perpendicular to the radius of the bend of the locking hook.

10. The spacer of claim 9, wherein the radius of the arcuate bend and the radius of the bend of the locking hook lie on the same vertical plane.

11. The spacer of claim 4, wherein each cage in the first plurality of cages comprises of a plurality of parallel spaced-apart horizontal wires joined to a plurality of parallel spaced-apart vertical wires and which cages are positioned in a form that has spaced-apart inner surfaces, and wherein the locking hook extends, inwardly and then upwardly around the same wire as engaged by the arcuate bend.

12. The spacer of claim 4, wherein the second end of the central straight portion further comprises of an arcuate bend, an eye, and a locking leg that is a mirror image of the first end.

13. A spacer for positioning apart cages used in forms for producing concrete structures, the spacer comprising:

a continuous length of material comprising a central straight portion with a first end and a second end;

an arcuate bend formed at the first end of the central straight portion by a downward bend at an angle greater than ninety degrees relative to the central straight portion;

an eye extending from the arcuate bend with a first end extending from the arcuate bend and a second end formed from an upward bend in the continuous length of material to elevate the second end of the eye above the central straight portion; and a locking leg extending from the second end of the eye downward and upward forming a locking hook being engageable with either a vertical or horizontal wire of the cages.

14. The spacer of claim 13, wherein the eye further comprises of a rounded nose that is engageable with an inner surface of the concrete form to position an outer cage of the cages a predetermined distance away from the inner surface of the concrete form.

15. The spacer of claim 13, wherein the arcuate bend has a radius and wherein the locking hook has a bend with a radius and wherein a plane perpendicular to the radius of the arcuate bend is parallel to a plane perpendicular to the radius of the bend of the locking hook.

16. The spacer of claim 15, wherein the radius of the arcuate bend and the radius of the bend of the locking hook lie on the same vertical plane.

17. The spacer of claim 15, wherein the radius of the arcuate bend and the radius of the bend of the locking hook lie on the same vertical plane.

18. The spacer of claim 13, wherein the second end of the central straight portion further comprises of an arcuate bend, an eye, and a locking leg that is a mirror image of the first end.

* * * * *